United States Patent [19]

Dahan

[11] 4,384,189

[45] May 17, 1983

[54] CONVECTION RADIATOR

[76] Inventor: Jacques J. Dahan, 71, rue Broca, 75013 Paris, France

[21] Appl. No.: 85,295

[22] Filed: Oct. 16, 1979

[30] Foreign Application Priority Data

Oct. 20, 1978 [FR] France ..... 78 29966

[51] Int. Cl.[3] ..... H05B 1/02

[52] U.S. Cl. ..... 219/364; 219/367; 219/370

[58] Field of Search ..... 219/363-365, 219/367, 370, 380-382, 371; 126/110 AA; 165/122

[56] References Cited

U.S. PATENT DOCUMENTS 1,886,894 8/1932 Modine ..... 165/122
3,855,450 12/1974 O'Connor ..... 219/364
4,110,600 8/1978 Spotts et al. ..... 126/110 AA

FOREIGN PATENT DOCUMENTS 2148404 3/1973 France .
431748 8/1967 Switzerland .
523378 7/1940 United Kingdom .

*Primary Examiner*—Bernard Roskoski
*Attorney, Agent, or Firm*—Steinberg & Raskin

[57] ABSTRACT

The present invention relates to a novel convection radiator.

A convection radiator comprising a system of air circulation by natural convection and a system of air circulation by forced convection including an air convection means, such as a turbine, each of the two air circulation systems comprising a first air circulation passage, a second air circulation passage, and a heating element separating the two passages, wherein the said second passage of the said system of air circulation by natural convection is also the said first passage of the said system of air circulation by forced convection, the warm air outlet of the said system of air circulation by forced convection being located substantially at ground level, a single heating element thus being common to both said air circulation systems.

7 Claims, 6 Drawing Figures

CONVECTION RADIATOR

The present invention relates generally to room heating devices and more particularly a novel convection radiator.

Various types of radiators, particularly convection radiators, are known. These are designed to operate by either natural- or forced-convection. As a rule, in the case of the natural-convection mode of operation, such radiators are constituted by a body comprising a first opening at its lower portion for the admission of cold air, of a heating element, and of a second opening at the upper portion of the body for the discharge of warm air. On the other hand, in the case of the forced-convection mode of operation, such a radiator additionally comprises an electro-mechanical device such as a fan or a turbine, an inlet of which sucks the cold air admitted through the first opening. Such an electric radiator may accessorily be equipped with a switch allowing for different heating conditions and with a thermostat.

However, electric convection radiators of the type just described suffer from a major drawback. Indeed, due to the fact that the direction of the air flow is the same in both convection modes, i.e. from bottom to top, the warm air can only escape from the radiator at its upper portion or at the upper portion of one or both of its side walls. Thus, the medium and upper layers of the surrounding air are unduly heated, whereas the air layers located near the ground are insufficiently heated for they are not imparted a convective motion. This results in an unpleasant feeling of discomfort (cold feet) which may lead to physiological ailment and even to the resulting diseases (colds, influenza, and so forth).

The present invention has particularly for its object to remedy this drawback by providing a new convection radiator using natural-convection heating or forced-convection heating alike, and wherein the direction of the air flow in the forced-convection mode of operation is opposite to that of the air flow in the natural-convection mode of operation. Thus, in the case of forced-convection, a sheet of warm air is blown very quickly at the level of the ground. In addition, in the case of natural convection, a noiseless mode of heating is available which undoubtedly is an advantage from the point of view of both comfort (e.g. heating during the night) and energy saving (no electric power consumption by the motor).

To this end, the invention provides a new convection radiator using either natural-convection heating or forced-convection heating, of the type comprising a system of air circulation by natural convection and a system of air circulation by forced convection including an air convection means such as for example a turbine, each of the two air circulation systems comprising a first air circulation passage communicating with at least one cold air inlet, a second air circulation passage communicating with at least one warm air outlet, and a heating element such as a resistor separating the two passages, characterized in that the said second passage of the said system of air circulation by natural convection is also the said first passage of the said system of air circulation by forced convection, and in that the said warm air outlet of the said system of air circulation by forced convection is located substantially at the level of the ground, a single heating element thus being common to both said air circulation systems.

It is thus understood that in the case of use in the forced-convection mode, the direction of the air flow is reversed since the cold air enters through the top and the warm air escapes from the lower portion of the radiator.

According to another characterizing feature of the invention, the said air convection means is located in the said second passage of the system of air circulation by forced convection, below the single heating element.

According to another characterizing feature of the invention, the said cold air inlet communicating with the said first passage of the system of air circulation by forced convection, which corresponds to the said warm air outlet communicating with the said second passage of the system of air circulation by natural convection is located on the upper portion of the radiator, preferably on its upper horizontal face.

Also according to the invention, the said cold air inlet communicating with the said first passage of the system of air circulation by natural convection is located on the lower portion of the radiator, preferably on its lower horizontal face, and in that the said warm air outlet of the system of air circulation by forced convection is located on the lower side portion of the said radiator.

Other characterizing features and advantages of the invention will appear more clearly from the following detailed description made with reference to the appended drawings given solely by way of example and wherein.

Figures 1, 2, 3, 4:
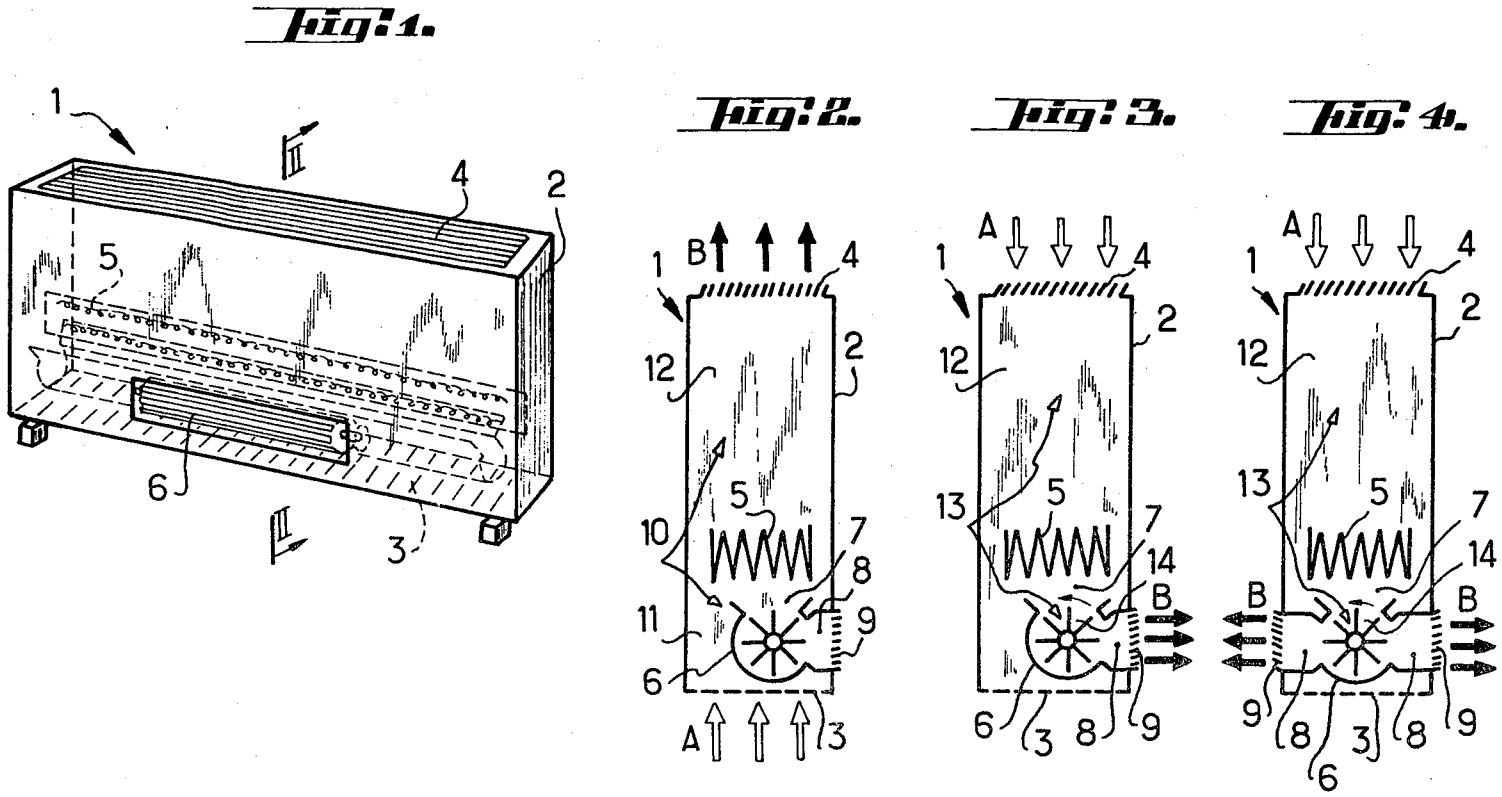
FIG. 1 is a perspective view of the convection radiator.
FIG. 2 is a sectional view upon the line II—II of FIG. 1, in the case of operation by natural convection.
FIG. 3 is a sectional view upon the line II—II of FIG. 1, in the case of operation by forced convection.
FIG. 4 is a view similar to FIG. 3 illustrating another form of embodiment of the invention.

According to one example of embodiment and referring to the appended drawings, a convection radiator 1 according to the invention comprises a body 2 provided at its lower portion with an opening 3 and at its upper portion with another opening 4, the openings 3 and 4 having appropriate dimensions and being usually provided with a protection device such as a grid, grate, ears or the like.

The radiator 1 includes a heating element such as for example an electric radiator 5 which may extend throughout the width of the apparatus. The resistor 5 may be made in various manners such as: spiral wire, braided, "sheathed"-type resistor, or any other type.

Under the resistor 5 is placed an air convection means 6 such as for example a shrouded turbine of appropriate shape, dimensions and flow rate, the intake port 7 of which is placed at the top thereof, i.e. in immediate proximity to the resistor 5, and the discharge port 8 of which is located opposite a corresponding opening 9 provided in the body 2, the said opening 9 being itself provided with a protection device such as a grid, grate, ears or the like.

As seen in FIG. 2, a system of air circulation by natural convection 10 can be defined so as to comprise a first air circulation passage 11 and a second air circulation passage 12, the resistor 5 separating the two passages. The first air circulation passage 11 communicates with the opening 3 corresponding to the cold air inlet, the arrows A illustrating the injection of cold air. On the other hand, the second air circulation passage 12 communicates with the opening 4 corresponding to the warm air outlet, the arrows B illustrating the ejection of the warm air.

The opening 4, i.e. the warm air outlet in the natural convection heating mode, also serves as a cold air inlet in the case of heating by forced convection, as seen in FIG. 3 where the arrows A illustrate the injection of cold air.

Moreover, in FIG. 3, a system of air circulation by forced convection 13 can be defined to comprise a first air circulation passage 12 which corresponds to the second passage 12 of the system of air circulation by natural convection 10 (FIG. 2), and a second air circulation passage 14. The resistor 5 also separates the two air circulation passages 12 and 14 and is therefore common to both air circulation systems 10 and 13. The first passage 12 of the system of air circulation by forced-convection 13 communicates with the opening 4 corresponding to the cold air inlet, and the second air circulation passage 14 includes the shrouded turbine 6 whose discharge port 8 communicates with the opening 9 corresponding to the warm air outlet, the arrows B of FIG. 3 illustrating the ejection of warm air.

As seen in FIGS. 2 and 3, the opening 9, i.e. the warm air outlet of the system of air circulation by forced convection 13, is located substantially at the level of the ground, preferably on the lower side portion of the body 2 of the radiator 1. On the other hand, opening 4, i.e. the cold air inlet of the system of air circulation by forced convection 13, is located on the upper portion of the radiator 1, preferably on its upper horizontal face.

According to another form of embodiment of the present invention illustrated in FIG. 4, the shrouded turbine 6 includes two discharge ports 8 located opposite the two corresponding openings 9 provided in the body 2. When the radiator is used in the forced-convection mode, this form of embodiment allows a sheet of warm air to be blown from each side of the radiator, thus increasing its efficiency, particularly in the case of an auxiliary heating radiator placed in the middle of a room.

The operation and the manner of using the electric convection radiator according to the invention can be inferred from the foregoing description and will now be explained.

When the radiator 1 is used in the natural-convection mode, the resistor 5 is switched on without operating the turbine 6. Cold air is admitted into the first passage 11 through the medium of the lower opening 3, is heated by passing over the resistor 5, is admitted into the second passage 12 of the system of air circulation by natural convection 10, and is discharged through the upper opening 4. The respective dimensions and the arrangement of resistor 5 and the turbine 6 are designed so that the required air flow parameters are ensured and the resistor element 5 is not heated red-hot.

In using the radiator 1 in the forced-convection mode, the resistor 5 and the turbine 6 are put into operation simultaneously. Cold air is admitted into the first passage 12 of the system of air circulation by forced convection 13 through the upper opening 4, escapes by passing over the resistor 5 and is admitted into the second passage 14 by entering the turbine 6 through its intake port 7. It is discharged therefrom through the port 8 and escapes through the opening 9. If the turbine 6 has two discharge ports 8, the warm air escapes through both openings 9.

The switching over from one mode of operation to the other, i.e. from the natural-convection heating mode to the forced-convection heating mode and vice versa, can be made manually, e.g. by actuating a switch mounted in the heating resistor and turbine control circuit, respectively.

It has been found, however, that under such conditions, the temperature in the heated room is often too high or too low, but seldom has the desired value felt as being pleasant by persons present in the room and, moreover, cannot be maintained at that level for a certain length of time. In addition to this disadvantage, the manual control does not ensure optimum operating conditions for the radiator, resulting generally in a waste of primary energy, i.e. of the energy consumed by the resistor and the turbine.

Figure 5:
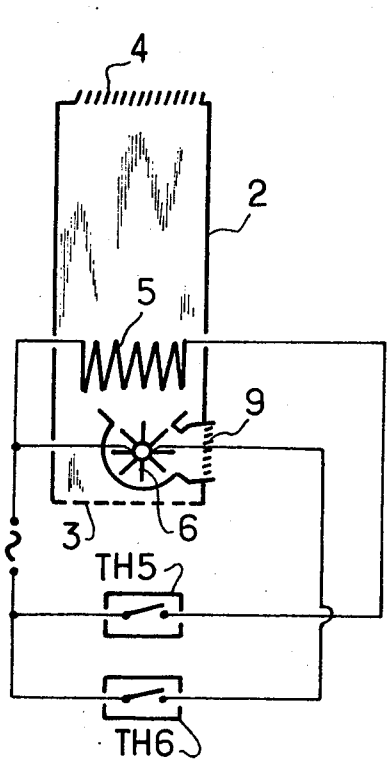
FIG. 5 is a diagrammatic view of the radiator according to the invention equipped with an automatic control device, and, FIG. 6 illustrates in the form of several curves the results of temperature measurements effected at several locations of a room equipped with the said radiator, during the operation of the automatic control device.

According to FIG. 5, the switching over from one operating mode to the other is effected by means of an automatic control device. This device comprises, in the example described and illustrated, a first thermostat $TH_6$ mounted in the control circuit of the turbine 6 and advantageously a second thermostat $TH_5$ placed in the electric circuit of the resistor 5.

Each thermostat comprises a lower temperature threshold which constitutes the threshold at which the unit to be controlled is started and an upper temperature threshold at which that unit is stopped. Thus, each thermostat switches on and off the controlled unit to which it is associated according to whether the temperature detected has reached or is lower than the lower temperature threshold, or whether it has reached or is higher than the upper temperature threshold.

The thermostat $TH_6$ for the control of turbine 6 is adjusted to ensure that the temperature at ground level is automatically maintained within a desired temperature range, whereas the thermostat $TH_5$ of the heating resistor 5 ensures the maintenance of a general comfortable ambient temperature in the room to be heated. The temperature thresholds of both thermostats are adjustable.

The operation of the radiator controlled by the control device according to the invention is easily inferred from the above description of the radiator and its automatic control device. An initial state will be assumed where the radiator operates in the natural-convection heating mode. The turbine is inoperative. When the temperature at ground level, which diminishes as a result of heat losses, reaches the lower temperature threshold, the thermostat $TH_6$ starts the turbine 6. The radiator therefore works in the forced-convection heating mode. The temperature at ground level increases until the thermostat $TH_6$ senses that the upper threshold temperature is reached and switches off the turbine. At the end of the resulting decrease in temperature, the turbine is again started. Consequently, the thermostat $TH_6$ ensures the maintenance of a pleasant temperature at ground level by periodically switching on the turbine 6.

The same applies to the resistor 5, which is periodically started by its thermostat $TH_5$ connecting it to the source of electric energy when the temperature detected reaches the lower threshold and breaks the current supply circuit when the upper threshold is reached.

Figure 6:
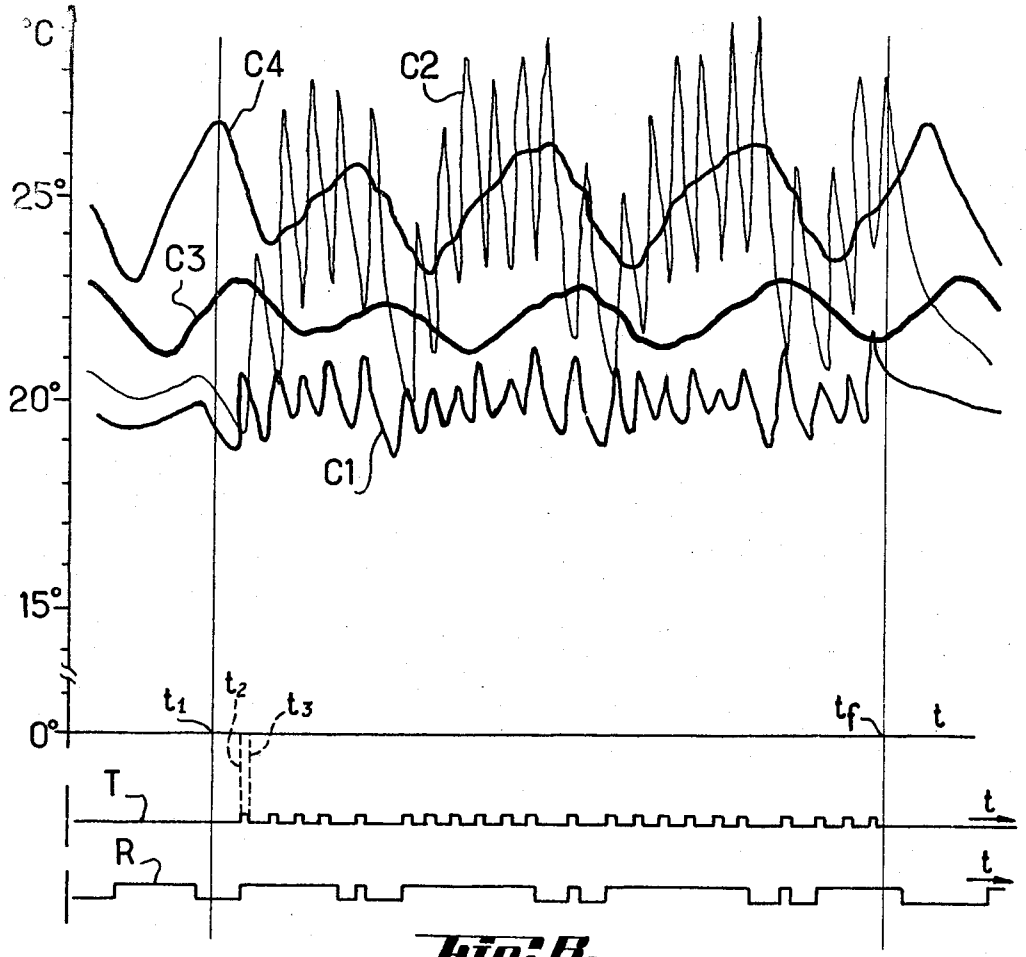

FIG. 6 clearly illustrates such periodical operation of the resistor 5 and the turbine 6. This Figure shows in the form of four curves C1 to C4 the variation of the temperature measured at four different locations within a room in which is placed the radiator. The curves C1 and C2 relate to the temperature at ground level, the location of the measurement corresponding to curve C1 being more distant from the radiator than that of curve C2. The curve C3 illustrates the temperature variation at mid height of the room, approximately at the same distance from the radiator as the location corresponding to the curve C2. The curve C4 has been obtained by measuring the temperature in proximity to the room ceiling. The curves T and R, below the abscissa t, illustrate the operating state of the turbine 6 (curve T) and of the resistor 5 (curve R), correspondingly with the temperature states indicated by the curves C1 to C4. The thermostats $TH_6$ and $TH_5$ have been adjusted to lower threshold values of 19° and 20° C. respectively.

Referring to FIG. 6, it is seen that the cold air is introduced into the room at the point of time $t_1$. The resistor 5 and the turbine 6 are inoperative. At point $t_2$, the thermostats $TH_5$ and $TH_6$ sense that the temperature has reached the lower threshold for which they are adjusted. The thermostats therefore start the resistor 5 and the turbine 6. At point $t_3$ the thermostat $TH_6$ senses that its upper temperature threshold has been reached and stops the turbine. As appears from FIG. 6, correspondingly to the rapid rate of variation of the temperature at ground level (curves C1 and C3), the turbine 6 operates only for short lengths of time following one another relatively rapidly compared with the operating periods of the resistor 5, illustrated by the curve R which corresponds to curves C3 and C4. The introduction of cold air ceases at point $t_f$.

In the example of FIG. 6, during the period of 51 minutes between instants $t_1$ and $t_f$, the resistor 5 is operated only for 37 minutes, which represents a saving of electric energy of about 27.5% with respect to a manual control mode of operation in which, under the circumstances described, the resistor would probably have been allowed to operate permanently. As far as the turbine is concerned, the saving of primary energy is considerable since the duration of effective operation of the turbine 6 is relatively short. The important energy saving is accompanied by a perfect maintenance of the temperatures at desired values.

In the example described and illustrated, the heating element is constituted by a resistor. It is evident that any other heating element can be used instead of the resistor, e.g. a gas, fuel oil, wood, coal or like heating element. Of course it may be sufficient in some cases to equip only the turbine with an automatic control device.

The invention is therefore by no means limited to the forms of embodiment described and illustrated, which have been given by way of example only. In particular, it comprises all means constituting technical equivalents to the means described as well as their combinations should the latter be carried out according to its gist and used within the scope of the following claims.

What is claimed is:

1. A convection radiator for functioning alternatively in a natural or in an air-flow inverting forced-convection heating mode, comprising: an enclosure having a bottom wall panel, heater means located within said enclosure, fan means including motor means located within said enclosure, an upper opening in said enclosure forming an inlet for cold air during forced convection heating and an outlet for warm air during natural convection heating, lower opening means provided in a bottom region of said enclosure at least adjacent said bottom wall panel forming an outlet for warm air during forced convection heating and an inlet for cold air during natural convection heating and control system means for controlling the operation of said heater means and said fan means as a function of predetermined temperature levels, and wherein said fan means are situated near said bottom wall panel of said enclosure substantially in front of said lower opening means forming an outlet for warm air during forced convection heating and said heater means are the only heater means operative during forced convection and natural convection heating with in both cases producing their maximum heating power and are situated only above said fan means and in a bottom area of said enclosure and upwardly from the fan means in the air current path through said radiator during forced-convection heating.

2. A convection radiator for functioning alternatively in a natural or in a forced-convection heating mode, comprising: an enclosure, electric heater means located within said enclosure, fan means including motor means located within said enclosure, an upper opening in said enclosure forming an inlet for cold air during forced convection heating and an outlet for warm air during natural convection heating, lower opening means provided in a bottom region of said enclosure forming an outlet for warm air during forced convection heating and an inlet for cold air during natural convection heating, and control system means for controlling the operation of said heater means and said fan means as a function of predetermined temperature levels, said control system means comprising circuit means including thermostat means and contact means controlled by said thermostat means for switching on or off said heater means and said fan means, wherein said heater means and said fan driving motor means are each connected in a separate control circuit and said thermostat means includes two separate thermostats, each thermostat controlling a contact means included in one of said circuit means for switching on or off a respective one of said fan means and said heater means independently from one another and having a lower switching on level and upper switching off level, the thermostat for controlling the fan means being responsive to the temperature in a region proximate to the floor of the space to be heated and the thermostat for controlling the heater means being adapted for being responsive to the temperature substantially spaced from said floor.

3. A radiator according to claim 2, wherein said lower opening means comprises an opening in a front panel of said enclosure in the lower region thereof for forming said outlet for warm air during forced convection heating and wherein said fan means are located substantially in front of said opening.

4. A radiator according to claim 2, wherein said single heating element consists of a resistor mounted above said fan means in the bottom portion of said enclosure.

5. A convection radiator for functioning alternatively in a natural or in a forced-convection heating mode, comprising: an enclosure, electric heater means located within said enclosure, fan means including motor means located within said enclosure, an upper opening in said enclosure forming an inlet for cold air during forced convection heating and an outlet for warm air during natural convection heating, lower opening means provided in the bottom region of said enclosure forming an outlet for warm air during forced convection heating and an inlet for cold air during natural convection heating, and control system means for controlling the operation of said heater means and said fan means as a function of predetermined temperature levels, said control system means comprising circuit means including thermostat means and contact means controlled by said thermostat means for switching on or off said heater means and said fan means, wherein said heater means and said motor means for driving said fan means are each connected in a separate control circuit and said thermostat means includes two separate thermostats, each thermostat controlling a contact means included in one of said circuit means for switching on or off a respective one of said fan means and said heater means, independently from one another, each thermostat having a lower switching on level and an upper switching off level, the thermostat for controlling the fan means being responsive to the temperature in a region proximate to the floor of the space to be heated and the thermostat for controlling the heater means being adapted for being responsive to the temperature substantially spaced from said floor, and wherein said fan means are situated in the bottom area of said enclosure and said heater means are formed by a single heating element situated above said fan means.

6. A radiator according to claim 5, wherein said lower opening means comprises an opening in a bottom panel of said enclosure for forming the inlet for cold air during natural convection heating.

7. A convection radiator for functioning alternatively in a natural or in an air-flow inverting forced-convection heating mode, comprising: an enclosure having a bottom wall panel, heater means located within said enclosure, fan means including motor means located within said enclosure, an upper opening in said enclosure forming an inlet for cold air during forced convection heating and an outlet for warm air during natural convection heating, lower opening means provided in a bottom region of said enclosure at least adjacent said bottom wall panel forming an outlet for warm air during forced convection heating and an inlet for cold air during natural convection heating and control system means for controlling the operation of said heater means and said fan means as a function of predetermined temperature levels, and wherein said fan means are situated near said bottom wall panel of said enclosure substantially in front of said lower opening means forming an outlet for warm air during forced convection heating and said heater means are the only heater means operative during forced convection and natural convection heating with in both cases producing their maximum heating power, said heater means consisting of a single heating element and are situated only above said fan means and in a bottom area of said enclosure and upwardly from the fan means in the air current path through said radiator during forced-convection heating.

* * * * *